US005122777A

United States Patent [19]

Shiratsuki et al.

[11] Patent Number: 5,122,777

[45] Date of Patent: Jun. 16, 1992

[54] RESISTOR FILM AND METHOD FOR FORMING THE SAME

[75] Inventors: Yoshiyuki Shiratsuki; Kumiko Takahashi; Kazuo Baba, all of Kanagawa, Japan

[73] Assignee: Fuji Xerox Co., Ltd., Tokyo, Japan

[21] Appl. No.: 548,235

[22] Filed: Jul. 5, 1990

[30] Foreign Application Priority Data

Jul. 10, 1989 [JP] Japan ..... 1-177364

[51] Int. Cl.[5] ..... H01C 1/012

[52] U.S. Cl. ..... 338/306; 338/309; 338/308; 338/314; 219/216; 252/512; 346/76 PH

[58] Field of Search ..... 338/306, 307, 308, 314; 252/512, 518, 519, 520, 521; 219/216; 346/76 PH

[56] References Cited

U.S. PATENT DOCUMENTS

Re. 30,313 6/1980 Carcia ..... 252/520
3,655,440 11/1972 Brady ..... 338/308 X
4,362,656 12/1982 Hormadaly ..... 252/518

FOREIGN PATENT DOCUMENTS 63-222931 10/1990 Japan .

*Primary Examiner*—Marvin M. Lateef
*Attorney, Agent, or Firm*—Finnegan, Henderson, Farabow, Garrett and Dunner

[57] ABSTRACT

A resistor film formed by applying onto a substrate a homogeneous mixture solution of metal organic compounds including metals selected from the element group of silicon (Si), bismuth (Bi), lead (Pb), aluminum (Al), zirconium (Zr), calcium (Ca), tin (Sn), boron (B), titanium (Ti), barium (Ba), and the like, and a metal selected from the group of iridium (Ir) and ruthenium (Ru) and burning the homogeneous mixture solution. The homogeneous mixture solution is burned at a temperature of 700° C. or more in an atmosphere of oxygen.

5 Claims, 9 Drawing Sheets

RESISTOR FILM AND METHOD FOR FORMING THE SAME

BACKGROUND OF THE INVENTION

The present invention relates to a resistor film for constituting a resistor to be used in various electronic parts such as hybrid ICs, thermal heads, and the like, and a method for forming such a resistor film. In particular, the invention relates to a resistor film formed by using thick-film technique, and a method for forming the same.

The technique for forming a resistor film is classified into two, namely, thick-film technique and thin-film technique. The thin-film technique is a technique for forming a resistor film on a surface of an insulating substrate in a vacuum container by means of vapor deposition, sputtering, or the like. The thin-film technique has an advantage in that a thin and uniform resistor film can be formed, but it has a problem in that a large-scaled production equipment to bring about an increase in cost is required.

The thick-film technique is a technique for forming a resistor film by applying or printing a resistor-forming paste or solution on a surface of an insulating substrate and drying and burning it. The thick-film technique has an advantage in that low equipment cost and high production efficiency can be attained However, the resistor film formed by using the conventional thick-film technique is, in general, thick. There arises a problem in that the heat capacity of the resistor film is large Further, the resistor film is formed of a sintered matter of powder having a particle size of the order of μm. Accordingly, there arises a problem in that the resistance value of the resistor film varies widely Consequently, there arises a problem in that a thermal head using the resistor film as a heating resistor is large in the quantity of energy consumption and is inferior in thermal response.

Heretofore, various techniques for producing a thin-film-like resistor film by using the aforementioned thick-film technique being low in the cost of the equipment have been proposed.

For example, Japanese Patent Unexamined Publication No. Sho-64-54710 has described a method for forming a thin-film-like resistor film containing a perovskite type ruthenate monolayer formed by applying a mixture solution of ruthenium octylate and alkaline-earth metal octylate and burning the mixture solution.

The resistor film containing a perovskite type ruthenate monolayer, described in the Japanese Patent Unexamined Publication No. Sho-64-54710, that is, the resistor film having a perovskite type crystal structure of ruthenium, has excellent film-forming characteristics (uniformity of the produced resistor film (in which the resistor film has no crack and no unevenness and has uniform resistance values in respective portions thereof), close adhesion to the surface of the substrate, and the like) and excellent electric characteristics (characteristics in the change of the resistance value at the time of electric power supply). However, it is difficult to produce the resistor film having a perovskite type crystal structure. It is considered that the reason is in that used materials and process conditions such as burning conditions and the like are severely restricted in order to form the resistor film having a perovskite type crystal structure.

On the other hand, the applicant of the present application has invented a method for producing a thin-film-like resistor film by using the aforementioned thick-film technique being low in the cost of equipment, that is to say, a metallo-organic deposition (MOD) method, and has filed a patent application (Japanese Patent Application No. Sho-63-222931). According to the MOD method, the resistor film for forming a heating resistor or the like is formed by applying onto a substrate a homogeneous mixture solution of metal organic compounds including metals selected from the metal group of silicon (Si), bismuth (Bi), lead (Pb), aluminum (Al), zirconium (Zr), calcium (Ca), tin (Sn), boron (B), titanium (Ti), barium (Ba), and the like, and a metal selected from the metal group of iridium (Ir), ruthenium (Ru), rhodium (Rh), and the like, and burning the homogeneous mixture solution.

The structure in components of the resistor film formed by the MOD method varies according to the conditions, such as metal organic material used, burning temperature, burning time, and the like. In short, the components of the resistor film formed by the MOD method may form one or two kinds of crystal structures, or may form no crystal structure. As the structure in components of the resistor film varies, the film-forming characteristics and electric characteristics of the resistor film vary.

SUMMARY OF THE INVENTION

Upon such circumstances, an object of the present invention is to provide a resistor film excellent in film-forming characteristics and electric characteristics, and a method for producing the same.

To accomplish the aforementioned object, the resistor film according to the present invention is formed by applying onto a substrate a homogeneous mixture solution of metal organic compounds including metals selected from the element group of silicon (Si), bismuth (Bi), lead (Pb), aluminum (Al), zirconium (Zr), calcium (Ca), tin (Sn), boron (B), titanium (Ti), barium (Ba), and the like, and a metal selected from the group of iridium (Ir) and ruthenium (Ru) and burning the homogeneous mixture solution, in which the crystal structure contained in the thus formed resistor film consists of a rutile type crystal structure of a metal oxide containing the metal selected from the group of iridium (Ir) and ruthenium (Ru).

Further, the resistor film according to the present invention is formed by applying onto a substrate a homogeneous mixture solution of metal organic compounds including iridium (Ir) and metals selected from the element group of silicon (Si), bismuth (Bi), lead (Pb), aluminum (Al), zirconium (Zr), calcium (Ca), tin (Sn), boron (B), titanium (Ti), barium (Ba), and the like, and burning the homogeneous mixture solution, in which the diffraction pattern of diffused wave when a Kα ray of copper is used as an incident X ray source exhibits strong peaks at the values of $2\theta$ of 28.1°, 34.7° and 54.1°, where $\theta$ represents the Bragg angle.

Furthermore, the resistor film according to the present invention is formed by applying onto a substrate a homogeneous mixture solution of metal organic compounds including ruthenium (Ru) and metals selected from the element group of silicon (Si), bismuth (Bi), lead (Pb), aluminum (Al), zirconium (Zr), calcium (Ca), tin (Sn), boron (B), titanium (Ti), barium (Ba), and the like, and burning the homogeneous mixture solution, in which the diffraction pattern of diffused wave when a Kα ray of copper is used as an incident X ray source exhibits strong peaks at the values of $2\theta$ of 28.1°, 35.2° and 54.4°, where $\theta$ represents the Bragg angle.

Still furthermore, the resistor film forming method according to the present invention comprises the steps of: applying onto a substrate a homogeneous mixture solution of metal organic compounds including metals selected from the element group of silicon (Si), bismuth (Bi), lead (Pb), aluminum (Al), zirconium (Zr), calcium (Ca), tin (Sn), boron (B), titanium (Ti), barium (Ba), and the like, and a metal selected from the group of iridium (Ir) and ruthenium (Ru); and burning the homogeneous mixture solution, in which the homogeneous mixture solution is burned at a peak temperature of 700° C. or more in an atmosphere of oxygen.

The resistor film according to the present invention is excellent in the above-mentioned electric characteristics and film-forming characteristics.

DETAILED DESCRIPTION OF THE PREFERRED EMBODIMENTS

A first embodiment of the invention will be described hereunder with reference to the accompanying drawings In this embodiment, the invention is applied to a thermal head.

Figure 1:
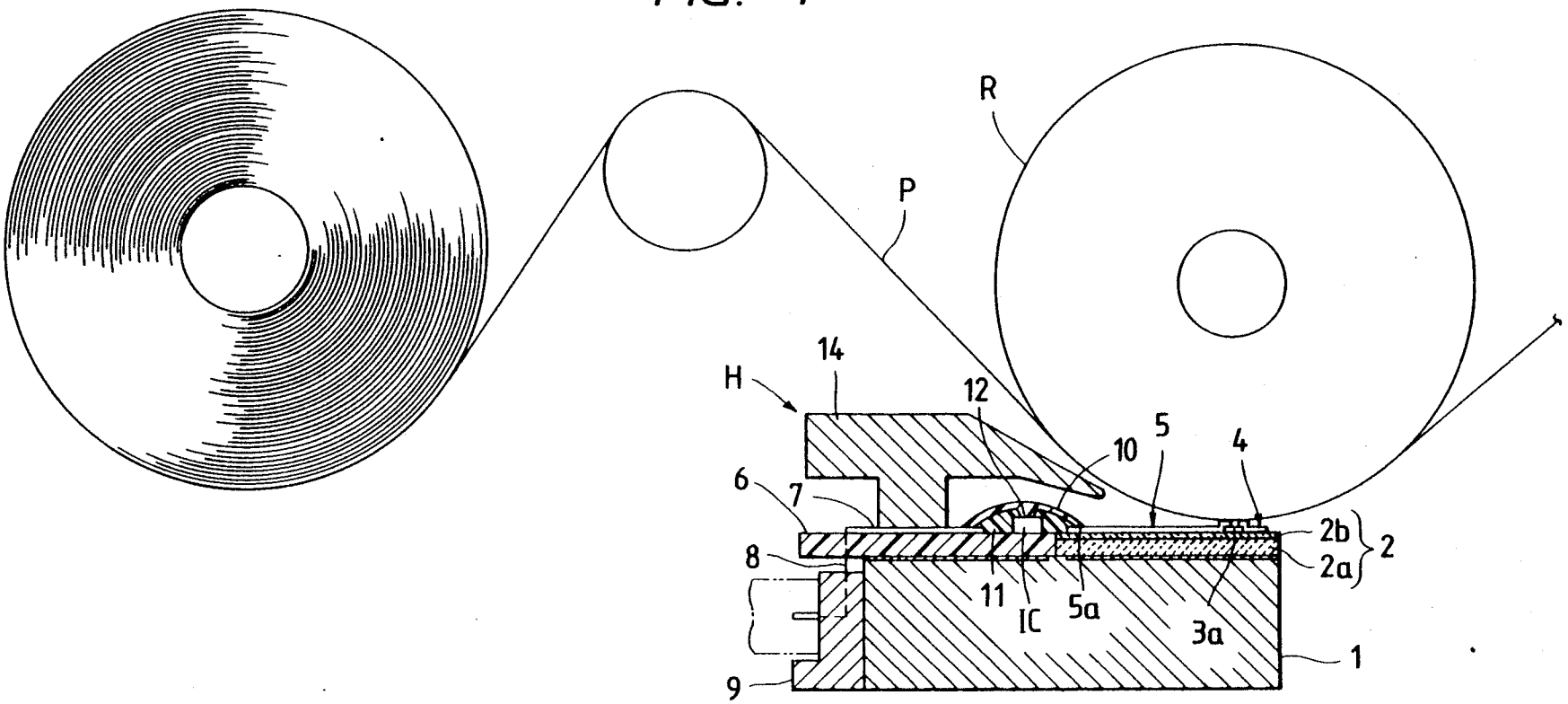
FIG. 1 is a view for explaining the whole of a thermal head to which a first embodiment of the invention is applied.
Figure 2:
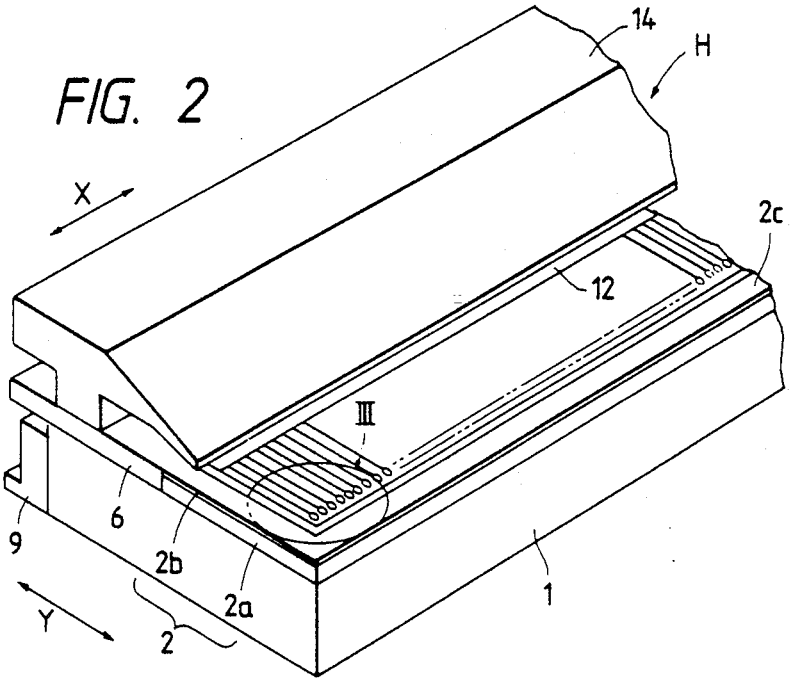
FIG. 2 is a perspective view showing important parts of the thermal head.
Figure 3:
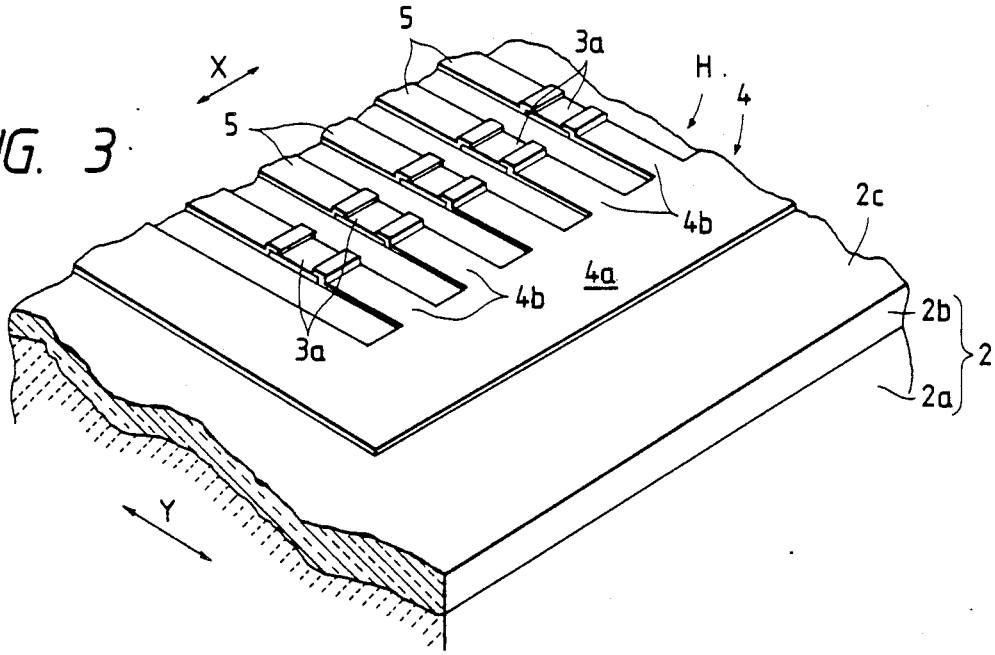
FIG. 3 is an enlarged view of a portion viewed from the direction of the arrow III in FIG. 2.
Figure 4A:
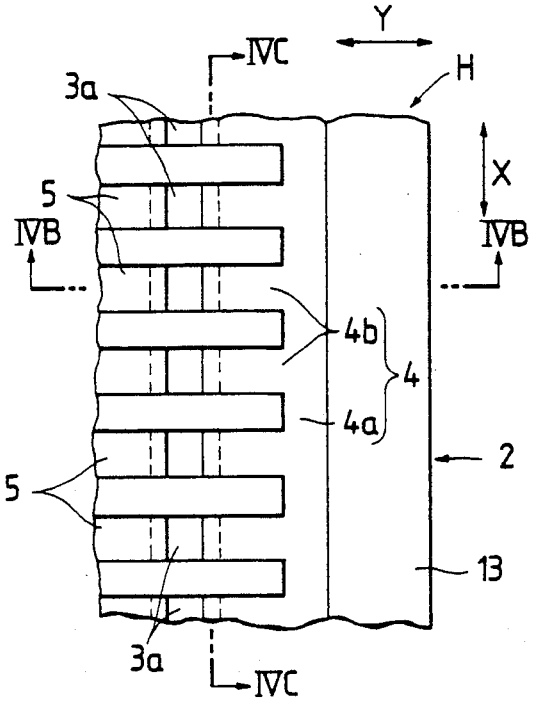
FIG. 4A is a plan view showing important parts of the thermal head.
Figure 4B:
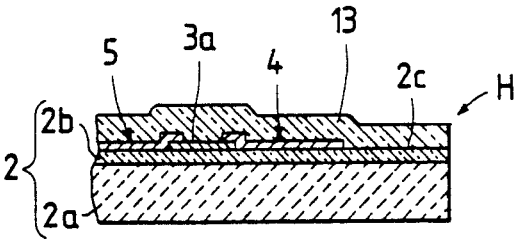
FIG. 4B is a sectional view taken along the line IVB—IVB in FIG. 4A.
Figure 4C:
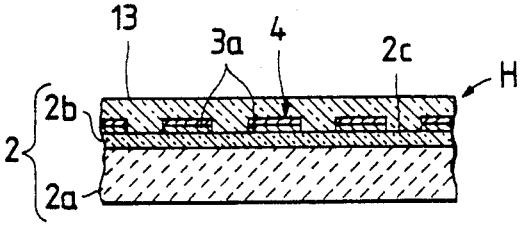
FIG. 4C is a sectional view taken along the line IVC—IVC in FIG. 4A.

FIG. 1 is a view for explaining the whole of a thermal head to which the invention is applied; FIG. 2 is a perspective view of important parts thereof; FIG. 3 is an enlarged view of a portion viewed in the direction of the arrow III in FIG. 2; FIG. 4A is a plan view of important parts in this embodiment; FIGS. 4B and 4C are sectional views respectively taken along the lines IVB—IVB and IVC—IVC in FIG. 4A; and FIGS. 5A through 11C are views for explaining a method for producing the thermal head.

As shown in FIG. 1, the thermal head H for performing thermal recording on thermal recording paper P is fed along the circumference of a platen roll R and over a supporting plate 1. An insulating substrate 2 is stuck to a surface of the supporting plate 1 by an adhesive agent at a right portion thereof in FIG. 1. The insulating substrate 2 comprises a body 2*a* made of alumina, and an underglaze layer 2*b* formed on a surface of the body 2*a* and having a thickness of about 60μm. As shown in FIG. 3, a plurality of individual resistor films 3*a* shaped like islands along a main scanning direction X are provided on a surface 2*c* of the insulating substrate 2.

On the insulating substrate surface 2*c*, there are formed a common electrode 4 comprising a belt-shaped common electrode body portion 4*a* and a plurality of common electrode connection portions 4*b* projecting from the common electrode body portion 4*a* in a subsidiary scanning direction Y so as to be shaped like a comb and individual electrodes 5 arranged at intervals of a predetermined distance so as to be opposite to the plurality of common electrode connection portions 4*b*. The respective common electrode connection portions 4*b* and the individual electrodes 5 are connected to the individual resistor films 3*a* provided along the main scanning direction X on the insulating substrate surface 2*c*. Base end portions (left end portions in FIG. 1) of the individual electrodes 5 are formed as IC connection terminals 5*a* for connection to a driving IC which will be described later.

A printed-wiring board 6 is stuck on the surface of the supporting plate 1 by an adhesive agent at a left portion thereof in FIG. 1. An outside connection wiring 7 is formed on a surface of the printed-wiring board 6. The outside connection wiring 7 is connected to a socket 9 as a drive signal input terminal, through a lead wire 8 piercing the printed-wiring board 6 in the input end side (left side in FIG. 1) thereof. A driving IC is provided in a portion of the printed-wiring board 6 which is near the insulating substrate 2. The driving IC is connected to the IC connection terminals 5*a* of the individual electrodes 5 and the outside connection wiring 7 by bonding wires 10 and 11.

The IC and the bonding wires 10 and 11 are coated with a protection resin 12. The individual resistor films 3*a*, the common electrode 4, the individual electrodes 5 and the like are coated with an abrasion-resistant layer 13 (not shown in FIGS. 1 through 3) (Refer to FIGS. 4B and 4C). The protection resin 12 is protected by a cover 14 made of aluminum.

The thermal head H is constituted by the parts designated by the reference numerals 1 through 14 and the driving IC.

In the following, a method for producing the thermal head H having a structure as shown in FIGS. 4A through 4C is described with reference to FIGS. 5A through 11C.

Figure 5A:
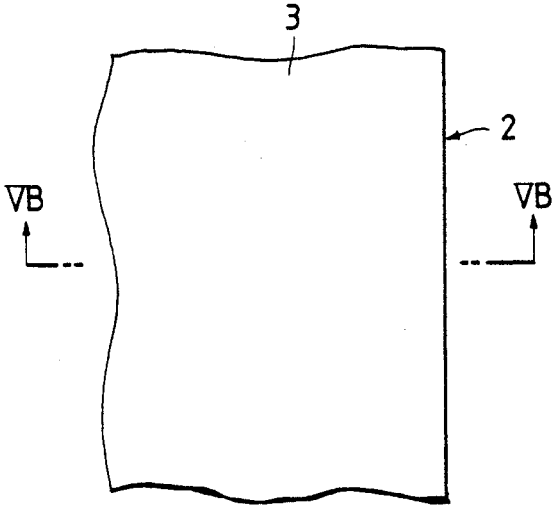
FIGS. 5A through 11C are views for explaining the method for producing parts depicted in FIGS. 4A through 4C.
Figure 5B:
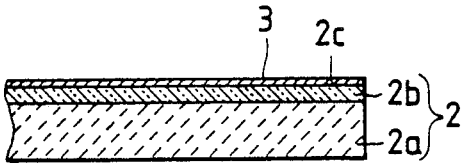

(a) Process of forming a Resistor Film (Refer to FIGS. 5A and 5B)

A metal organic material for forming a heating resistor is fully provided on the insulating substrate surface 2*c* by screen printing.

For example, a mixture of solutions having the following numbers in Metal Resinate (tradename) made in Engel-hard Corporation is used as the metal organic material for forming a resistor film.

A-1123 (Ir organic material)
#28-FC (Si organic material)
#8365 (Bi organic material)

Describing in detail, the aforementioned solutions are mixed in the proportion that Ir, Si and Bi will be mixed in the atomic proportion 1:1:1 after burning. Then, the viscosity of the mixture is adjusted to 5000–30000 cps by using a solvent such as α-Terpineol, butylcarbitol acetate, or the like. The resulting mixture is printed or applied on stainless screen having a mesh size of 100 to 400. The printed insulating substrate 2 is dried at 120° C. and then burned at 800° C. in an infrared belt burning furnace for 10 minutes to prepare a resistor film 3. The resistor film 3 thus prepared has a thickness of 0.1 to 0.5 μm. The sheet resistance of the resistor film is about 150 Ω per unit area when the thickness of the resistor film is 0.2 μm.

Figure 12:
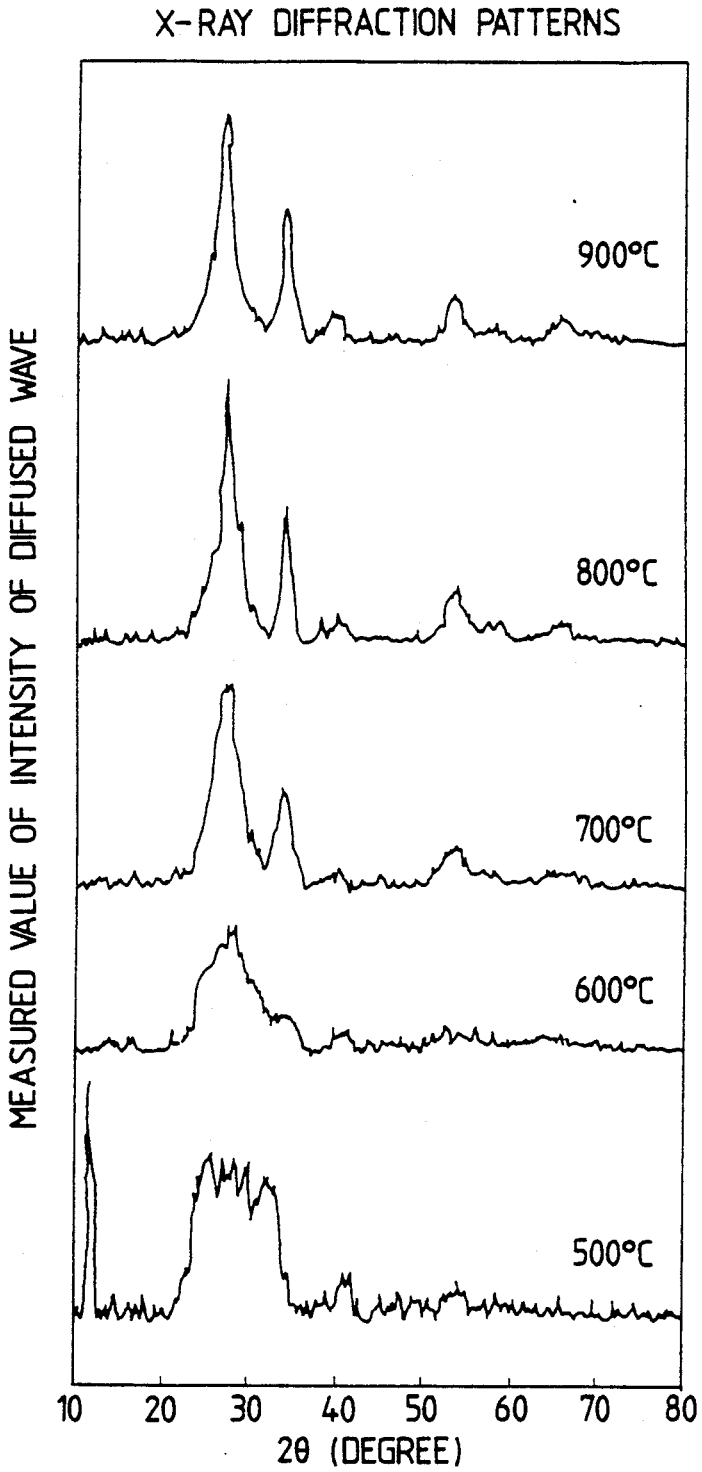
FIG. 12 is a graph view showing X-ray diffraction patterns of resistor films containing $IrO_2$ in the case where the resistor films are respectively prepared at different burning temperatures.

The resistor film 3 is subjected to X-ray diffraction analysis using Cu:Kα rays (wave length $\lambda=0.15406$ nm) as an X-ray source. As this result, a diffraction pattern of diffused wave in the case where the burning temperature is 800° C. is obtained as shown in FIG. 12. Further, X-ray diffraction patterns of resistor films respectively burned at other burning temperatures are also shown in FIG. 12. In FIG. 12, the abscissa shows a value ($2\theta$) twice the Bragg angle $\theta$ and the ordinate shows a measured value of intensity of diffused wave.

In general, the diffraction angle exhibits a unique value for each crystalline matter. Accordingly, each matter can be identified by examining peak angles in the diffraction pattern. Further, such peaks appear in the diffraction pattern when a certain crystallized matter exists. In addition, the size of the crystal and the regularity of the crystal grating can be estimated from the magnitude of the peaks. As shown in FIG. 12, the X-ray diffraction pattern of the resistor film 3 formed at a burning temperature of 800° C. exhibits peaks of measured intensity at the values of $2\theta$ of 28.1°, 34.7° and 54.1°. The matter exhibiting the aforementioned peaks is $IrO_2$ having a rutile type crystal structure.

In short, it is considered that the crystal structure contained in the resistor film 3 in this embodiment is $IrO_2$ alone and, accordingly, both Si and Bi exist in the form of non-crystal, that is, glass (amorphous).

As a formula for estimating the size of the crystal from the half-width of the measured intensity peak, the following Scherrer formula (a) is known generally.

$$t = \frac{K\lambda}{B\cos\theta} \quad \text{(a)}$$

t:length of a side of the crystal
K:Scherrer constant
λ:wave length of the X-ray
B:half-width in the diffraction pattern
θ:Bragg angle When the respective values are substituted into the aforementioned formula (a), the crystal size in the crystal structure of $IrO_2$ contained in the resistor film 3 in this embodiment is estimated to about 3 nm.

When the burning temperature is not less than 700° C., peaks in the diffraction pattern appear clearly at the values of $2\theta$ of 28.1°, 34.7° and 54.1° as shown in FIG. 12. In short, it is considered that the crystal structure contained in the resistor film burned at a burning temperature of 700° C. or more is constituted by $IrO_2$ alone. As the burning temperature increases, peaks in the diffraction pattern become sharp and, accordingly, the crystal size increases. In the case where a resistor film (in which the diffraction pattern is not shown) is prepared by burning at 800° C. for 5 minutes in the burning step in this embodiment, the crystal size of the crystal structure of $IrO_2$ contained in the resistor film becomes about 2 nm. In short, the crystal size (2 nm) in the case of burning for 5 minutes is smaller than the crystal size (3 nm) in the case of burning for 10 minutes. This shows that the crystal size increases as the burning time increases. When burning is made at a burning temperature of 900° C. for 30 minutes, the crystal size becomes 200 nm.

Figure 13:
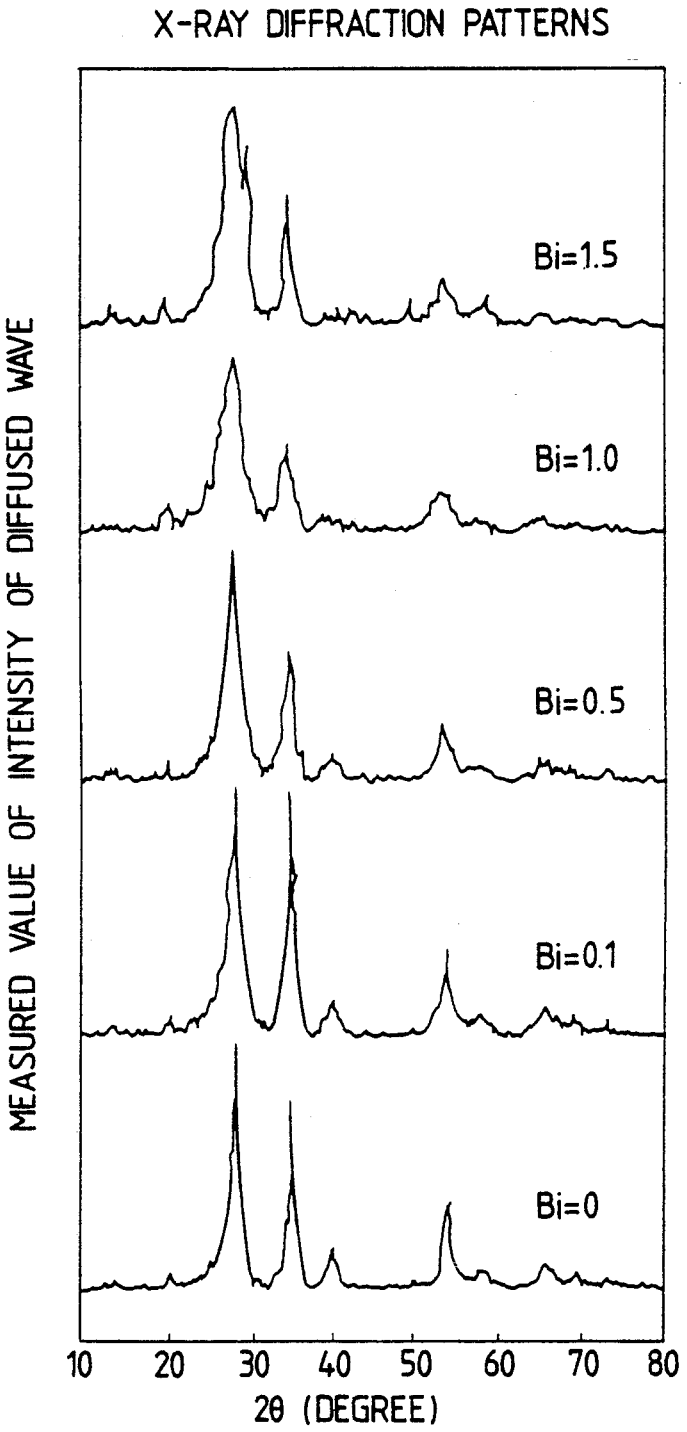
FIG. 13 is a graph view showing X-ray diffraction patterns of resistor films containing $IrO_2$ in the case where the resistor films are different in their Bi contents.

FIG. 13 shows X-ray diffraction patterns of resistor films formed in the case where the atomic proportion of Bi in the metal organic material to be printed or applied on the insulating substrate surface 2c is changed variously. In the case where the atomic proportion of Bi is set to zero, peaks in the diffraction pattern become sharp as shown in FIG. 13. In this case, the crystal size of the crystal structure of $IrO_2$ contained in the resistor film is about 10 nm. It is obvious from FIG. 13 that peaks in the diffraction pattern become sharp as the atomic proportion of Bi in the metal organic material decreases, that is, the crystal size of the crystal structure of $IrO_2$ contained in the resistor film increases as the atomic proportion of Bi decreases.

In short, the crystal size can be controlled by adjusting the quantity of a used metal such as Bi or by adjusting the burning temperature and burning time as described above. As this result, it is found that the resistor film having a crystal size of 2 to 200 nm is very excellent in film-forming characteristics.

(b) Process for preparing a Resist Pattern for forming a Heating Resistor (Refer to FIGS. 6A, 6B, 7A and 7B)

Figure 6A:
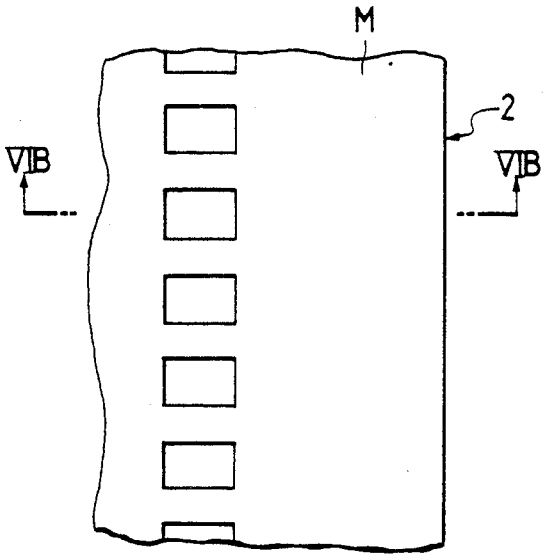
Figure 6B:
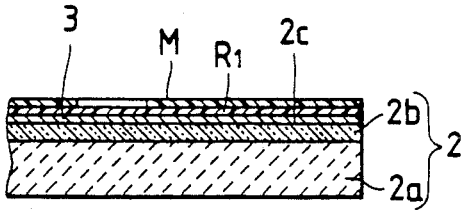
Figure 7A:
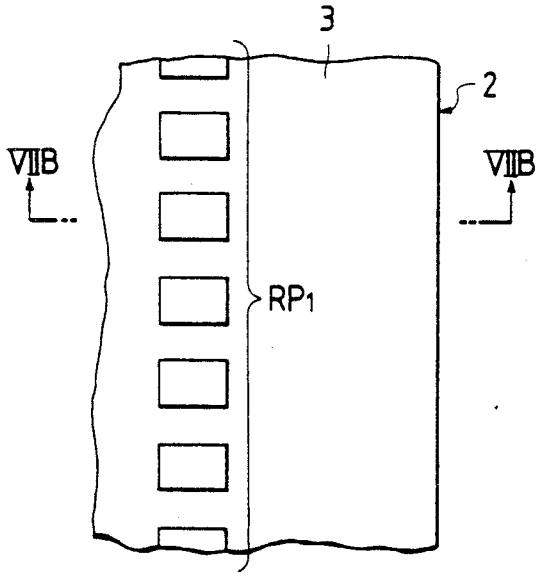
Figure 7B:
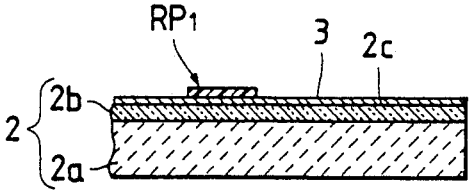

Then, a resist layer $R_1$ is formed on the resistor film 3 as shown in FIGS. 6A and 6B. Then, the resist layer is masked by an exposure mask M and subjected to exposure and development. Thus, a resist pastern $RP_1$ for forming individual resistors as shown in FIGS. 7A and 7B is prepared.

Figure 8A:
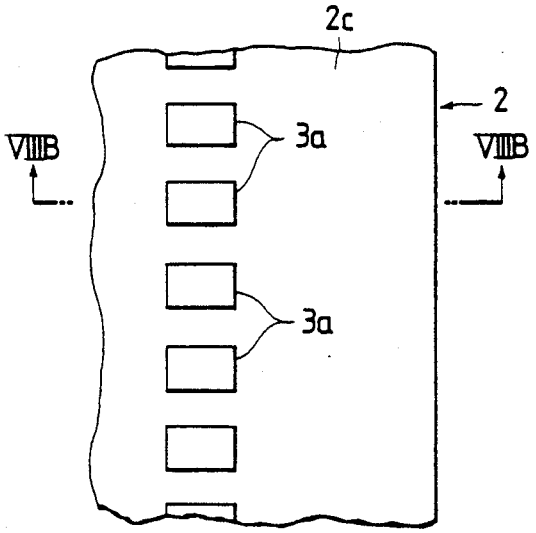
Figure 8B:
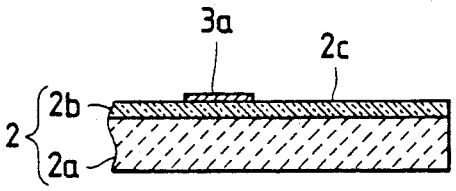

(c) Process for preparing Individual Resistors (Refer to FIGS. 8A and 8B)

Then, etching is carried out by using fluonitric acid (etching solution) to prepare a pattern of individual resistor films 3a.

Figure 9A:
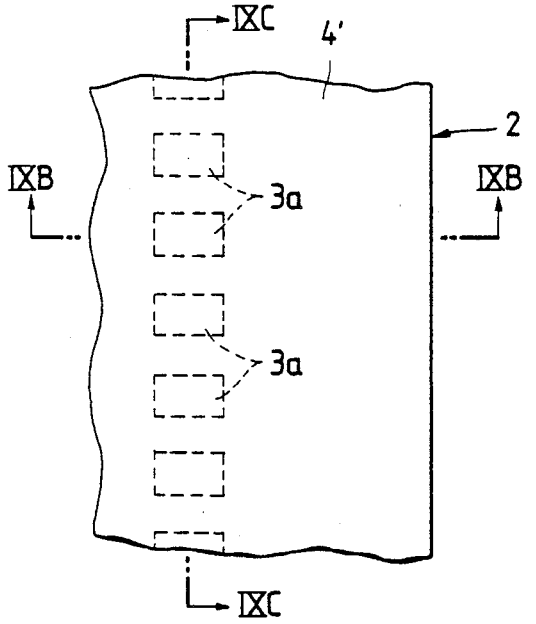
Figure 9B:
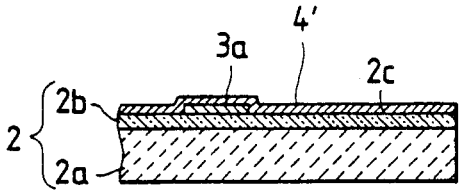
Figure 9C:
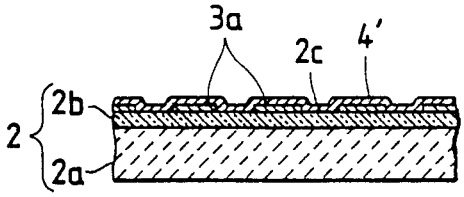

(d) Process for preparing a Gold Film (Refer to FIGS. 9A through 9C)

Then, metallo-organic gold paste D27 made in Noritake Co. Ltd. is fully printed on the insulating substrate surface 2c having the thus prepared individual resistor films and is burned to prepare a gold film 4'.

Figure 10A:
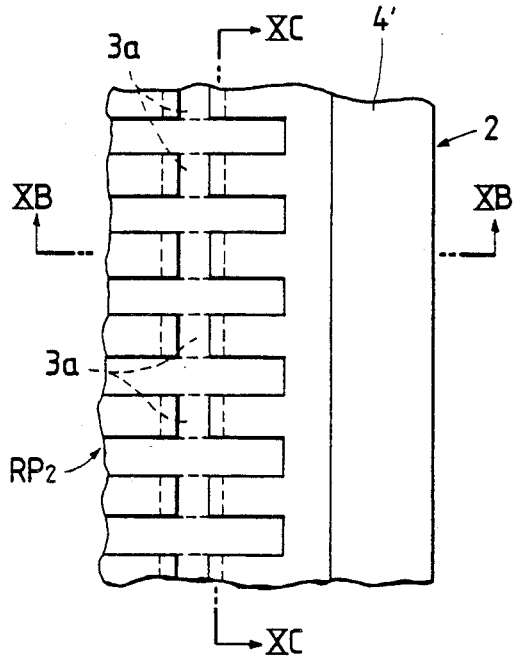
Figure 10B:
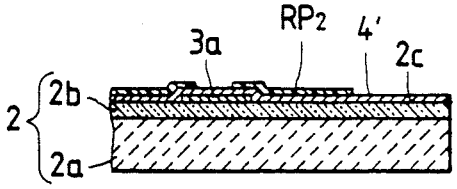
Figure 10C:
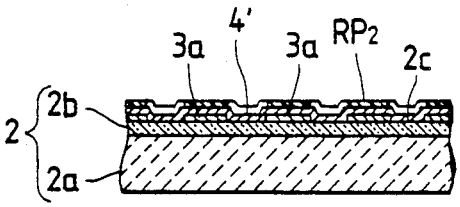

(e) Process for preparing a Resist Pattern for forming Electrodes (Refer to FIGS. 10A through 10C)

Then, a resist layer is formed on the gold film 4' and subjected to exposure and development to prepare a resist pattern $RP_2$ for forming electrodes.

Figure 11A:
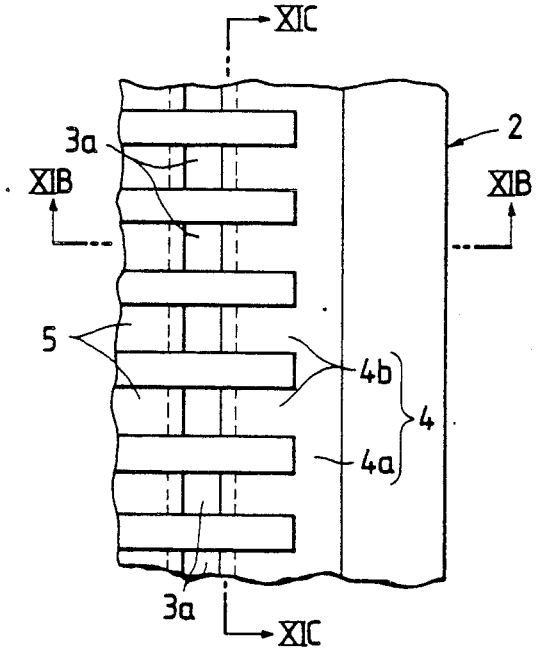
Figure 11B:
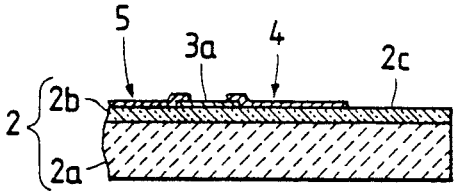
Figure 11C:
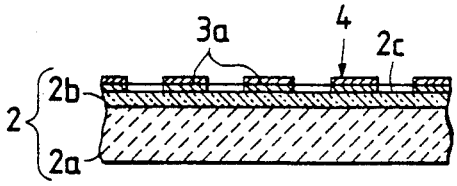

(f) Process for preparing Electrodes (Refer to FIGS. 11A through 11C)

Then, etching is carried out by using an iodine-potassium iodide solution (etching solution) to prepare a common electrode 4 and individual electrodes 5 from the gold film 4'.

(g) Process for preparing an Abrasion-Preventing Layer

Then, a metal organic material for forming an abrasion-resistant layer is fully applied onto the insulating substrate surface 2c including the individual resistor films 3a, common electrode 4 and individual electrodes 5, by screen printing.

For example, a mixture of solutions having the following numbers in Metal Resinate (tradename) made in Engel-hard Corporation is used as the metal organic material for forming an abrasion-resistant layer.

#28-FC (Si organic material)
#9428 (Ti organic material)
#8365 (Bi organic material)

Describing in detail, the aforementioned solutions are mixed in the proportion that Si, Ti and Bi will be mixed in the atomic proportion 1:1:0.5 after burning. Then, the viscosity of the mixture is adjusted to 5000–30000 cps by using a solvent such as α-Terpineol, butylcarbitol acetate, or the like. The resulting mixture is printed or applied on the insulating substrate surface 2c by using a stainless screen having a mesh size of 100 to 325. The printed insulating substrate 2 is dried at 120° C. and then burned at a peak temperature of 600° to 800° C. in an infrared belt burning furnace for 10 minutes to prepare an abrasion-preventing layer. Because the abrasion-resistant layer must be excellent in abrasion resistance, the process of the steps of applying the metal organic material for forming the abrasion-resistant layer, drying it, and burning it is repeated four times to finally prepare an abrasion-resistant layer 6 having a thickness of 1.6 to 2.0 μm. Thus, the thermal head H as shown in FIGS. 4A through 4C is prepared.

In the following, a second embodiment of the invention will be described. In this embodiment, the invention is also applied to a thermal head.

The thermal head in the second embodiment of the invention is similar to the thermal head in the first embodiment thereof, except that they are different in a part of the resistor film forming process described above with reference to FIGS. 5A and 5B.

In this embodiment, for example, a mixture of solutions having the following numbers in Metal Resinate (tradename) made in Engel-hard Corporation is used as the metal organic material for forming a resistor film in the resistor film forming process described above with reference to FIGS. 5A and 5B.

A-1124 (Ru organic material)
#28-FC (Si organic material)
#8365 (Bi organic material)

Describing in detail, the aforementioned solutions are mixed in the proportion that Ru, Si and Bi will be mixed in the atomic proportion 1:1:1 after burning. Then, the resulting mixture is subjected to viscosity adjustment, printing, drying and burning in the same manner as in the first embodiment, thus to prepare a resistor film. In this embodiment, the thickness of the resulting resistor film is from 0.1 to 0.5 μm. The sheet resistance of the resistor film is about 80 Ω per unit area when the thickness of the resistor film is 0.2 μm.

Figure 14:
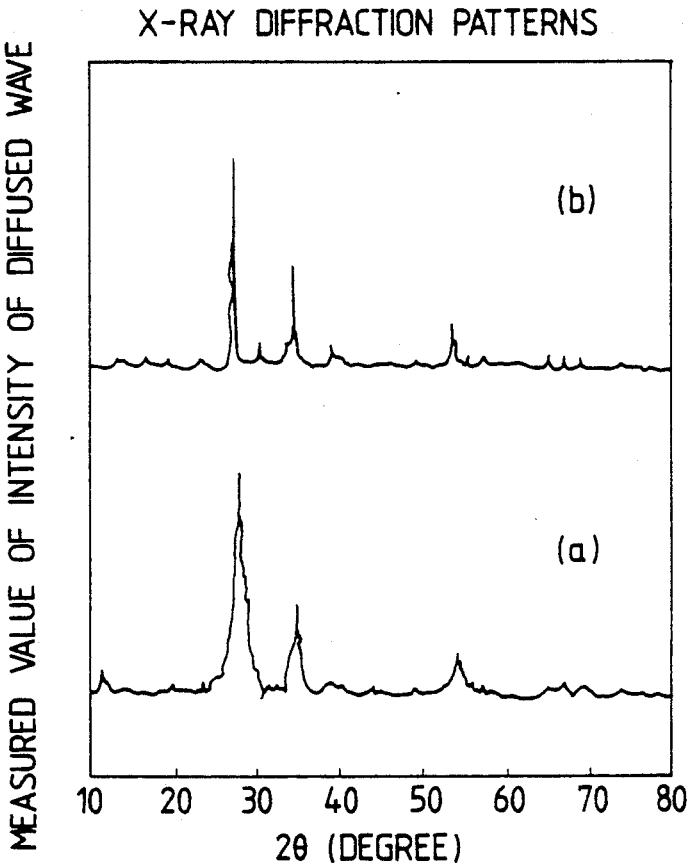
FIG. 14 is a graph view showing X-ray diffraction patterns of resistor films containing $RuO_2$, in which (a) shows an X-ray diffraction pattern of a resistor film as a second embodiment of the present invention, and (b) shows an X-ray diffraction pattern of a resistor film prepared by a conventional thick-film technique.

The X-ray diffraction pattern of the resistor film is as shown in FIG. 14(*a*). FIG. 14(*b*) shows an X-ray diffraction pattern of a conventional general thick-film type resistor film formed by applying thick-film type resistor preparing paste such as $RuO_2$ resistor preparing paste GZX or GZ (tradename) made in Tanaka Mathey K. K., drying it and burning it.

The X-ray pattern of the respective resistor film as shown in FIGS. 14(*a*) and 14(*b*) exhibits peaks of measured intensity at the values of 28 of 28.1°, 35.2° and 54.4°. The matter exhibiting the aforementioned peaks is $RuO_2$ having a rutile type crystal structure. The crystal structure contained in the resistor film having the diffraction pattern as shown in FIG. 14(*a*) in this embodiment is $RuO_2$ alone and, accordingly, both Si and Bi are not crystallized. In short, it is considered that both Si and Bi exist in the form of glass (amorphous).

As is obvious from FIGS. 14(*a*) and 14(*b*), the half-width in the diffraction pattern of the conventional thick-film type resistor film as shown in FIG. 14(*b*) is much smaller than the half-width in the diffraction pattern of the resistor film in this embodiment as shown in FIG. 14(*a*). This means that the crystal size of the crystal structure contained in the conventional resistor film as shown in FIG. 14(*b*) is larger than that in the resistor film in this embodiment as shown in FIG. 14(*a*). Because the crystal size of the crystal structure contained in the conventional thick-film type resistor film is larger than 20 nm, the conventional resistor film is inferior in film-forming characteristics.

Also in the $RuO_2$-containing resistor film formed according to the second embodiment, the crystal size of the rutile-type crystal structure of $RuO_2$ contained therein can be controlled by adjusting the used metal organic material, burning temperature, burning time, and the like, in the same manner as in the $IrO_2$-containing resistor film 3 formed according to the first embodiment. Consequently, it is found that a resistor film small in the change of the resistance value at the time of application of electric power, that is, a resistor film excellent in electric characteristics, can be prepared when the burning temperature is not less than 700° C.

Although embodiments of the invention as to a resistor film and a method for forming the same have been described, it is to be understood that the invention is not limited to the specific embodiments and that various changes and modifications may be made without departing from the spirit of the invention described in the scope of the claims.

For example, materials other than #28-FC (metal organic material of Si) and #8365 (metal organic material of Bi) in Metal Resinate (tradename) made in Engel-hard Corporation, used as the metal organic material for forming a resistor film, may be selected from #207-A (metal organic material of Pb), A3808 (metal organic material of Al), #5437 (metal organic material of Zn), 40B (metal organic material of Ca), #118B (metal organic material of Sn), #11-A (metal organic material of B), #9428 (metal organic material of Ti), #137-C (metal organic material of Ba), and the like. The Metal Resinate made in Engel-hard Corporation, used as the metal organic material for forming a resistor film, may be replaced by any suitable one of various metal organic materials as long as the metal organic material can form a complex of a metal and an organic matter such as carboxylic acid and can be dissolved in an organic solvent.

The screen printing method used as a method for applying the metal organic material onto the insulating substrate surface may be replaced by a dipping method, a roll coating method, a spin coating method or the like.

The resistor film according to the present invention is thin and excellent in film-forming characteristics. Accordingly, the resistor film is superior in thermal response, small in the amount of scatter in the resistance value, and large in pressure-resistant properties. Further, the resistor film according to the invention is excellent in electric characteristics. Accordingly, the resistor film is large in strength against electric field and electric power, and small in the change of the resistance value at the time of application of electric power. In addition, according to the method for forming a resistor film as related to the invention, a resistor film excellent both in the film-forming characteristics and in the electric characteristics can be formed by using a simple equipment without increase in cost.

What is claimed is:

1. A resistor film formed by:

applying onto a substrate a homogeneous mixture solution of metal organic compounds including:

metals selected from the element group consisting of silicon (Si), bismuth (Bi), lead (Pb), aluminum (Al), zirconium (Zr), calcium (Ca), tin (Sn), boron (B), titanium (Ti), and barium (Ba); and a metal selected from the group consisting of iridium (Ir) and ruthenium (Ru); and burning said homogeneous mixture solution, in which the crystal structure contained in the thus formed resistor film consists essentially of a rutile type crystal structure of a metal oxide containing the said metal selected from the group consisting of iridium (Ir) and ruthenium (Ru).

2. A resistor film according to claim 1, in which said metal oxide in said rutile type crystal structure contained in the thus formed resistor film has a crystal particle size in a range of 2 nm to 200 nm.

3. A resistor film formed by:

applying onto a substrate a homogeneous mixture solution of metal organic compounds including:

iridium (Ir) and metals selected from the element group consisting of silicon (Si), bismuth (Bi), lead (Pb), aluminum (Al), zirconium (Zr), calcium (Ca), tin (Sn), boron (B), titanium (Ti), and barium (Ba); and a metal selected from the group consisting of iridium (Ir) and ruthenium (Ru); and burning said homogeneous mixture solution, in which the diffraction pattern of diffused wave when a $K\alpha$ ray of copper is used as an incident X ray source exhibits strong peaks at the values of $2\theta$ of 28.1°, 34.7° and 54.1°, where $\theta$ represents the Bragg angle.

4. A resistor film formed by:

applying onto a substrate a homogeneous mixture solution of metal organic compounds including:

ruthenium (Ru) and metals selected from the element group consisting of silicon (Si), bismuth (Bi), lead (Pb), aluminum (Al), zirconium (Zr), calcium (Ca), tin (Sn), boron (B), titanium (Ti), and barium (Ba); and a metal selected from the group consisting of iridium (Ir) and ruthenium (Ru); and burning said homogeneous mixture solution, in which the diffraction pattern of diffused wave when a $K\alpha$ ray of copper is used as an incident X ray source exhibits strong peaks at the values of $2\theta$ of 28.1°, 35.2° and 54.1°, where $\theta$ represents the Bragg angle.

5. A method for forming a resistor film comprising the steps of:

applying onto a substrate a homogeneous mixture solution of metal organic compounds including:

metals selected from the element group consisting of silicon (Si), bismuth (Bi), lead (Pb), aluminum (Al), zirconium (Zr), calcium (Ca), tin (Sn), boron (B), titanium (Ti), and barium (Ba); and a metal selected from the group consisting of iridium (Ir) and ruthenium (Ru); and burning said homogeneous mixture solution, in which said homogeneous mixture solution is burned at a temperature of 700° or more in an atmosphere of oxygen.

* * * * *